United States Patent [19]

Clausin

[11] Patent Number: 4,620,498

[45] Date of Patent: Nov. 4, 1986

[54] DEVICE FOR LIMITING THE ROTATIONAL MOVEMENT OF THE EXTERNAL PART OF THE SWIVEL OF A SAIL ROLLER FOR SAILING BOATS

[75] Inventor: Pierre Clausin, Ville d'Avray, France

[73] Assignee: Proengin, France

[21] Appl. No.: 714,414

[22] Filed: Mar. 21, 1985

[30] Foreign Application Priority Data

Oct. 31, 1984 [FR] France ..... 84 16783

[51] Int. Cl.[4] ..... B63H 9/10

[52] U.S. Cl. ..... 114/106; 114/107

[58] Field of Search ..... 114/104, 106, 107, 108, 114/111, 112, 113, 114

[56] References Cited

U.S. PATENT DOCUMENTS 3,851,610 12/1974 Greene ..... 114/106
4,122,793 10/1978 Molz ..... 114/106
4,266,495 5/1981 Hood ..... 114/107 X

FOREIGN PATENT DOCUMENTS 2133363 7/1984 United Kingdom ..... 114/104

*Primary Examiner*—Sherman D. Basinger
*Assistant Examiner*—Paul E. Salmon
*Attorney, Agent, or Firm*—William A. Drucker

[57] ABSTRACT

A device for limiting the rotational movement of the outer part of the swivel of a sail roller equipping a sailing boat comprising at least a mast, a stay cable having an end portion adapted for connecting the stay to the mast, and a halyard fixed to the swivel by a connecting piece and passing over a sheave provided at the head of the mast, the roller comprising at least one tube on which the sail may be rolled and which is mounted for rotation about the stay cable, the swivel comprising an inner part mounted for sliding on the tube and secured for rotation therewith, this inner part being fixed to the sail, and an outer part mounted for rotation on the inner part and on which are mounted the connecting piece, the device further comprising at least one piece secured against axial and rotational movement to the stay cable and situated in a zone between the upper end of the tube and the end portion of the stay, and comprising at least two abutment surfaces which extend radially and which cooperate with the connecting piece, when the swivel is at the level of the upper end of the tube.

9 Claims, 5 Drawing Figures

DEVICE FOR LIMITING THE ROTATIONAL MOVEMENT OF THE EXTERNAL PART OF THE SWIVEL OF A SAIL ROLLER FOR SAILING BOATS

BACKGROUND OF THE INVENTION

1. Field of the Invention

The invention relates to sail reducing devices which operate by winding the sail on a tube, such as jib sail or main sail rollers for example.

2. Description of the prior art

In these devices, the sail hoist is fixed to the tube of the roller by a bolt rope and positioning of the sail, in other words hoisting thereof is effected by fitting the bolt rope into a longitudinal groove provided in the tube as the sail is gradually hauled towards the upper end of the tube by means of a halyard connected to the head of the sail. For hoisting the sail, the most sophisticated rollers use the jib sail halyard which forms part of the current basic rigging. So as to allow freedom of rotation between the head of the sail which rotates with the tube during operation of the roller and the halyard adjoining the mast, a swivel is inserted between these two latter; it comprises an inner part sliding on the tube and on which the head of the sail is fixed and an outer part guided for rotation about the preceding one and on which the halyard is bent.

The correct operation of the roller is only possible if the part of the swivel fixed to the halyard is subjected by this latter to a permanent resisting torque sufficient to avoid it being rotated during operation of the roller, since, because of the inevitable friction which appears at the level of the means which provides rotational guidance between the two parts of the swivel, the driving force causes the halyard to wrap itself round the tube and leads to jamming of the roller. In the known devices, the resistant torque can only be obtained if the halyard is stretched and moves substantially away from the axis of rotation of the roller. The first condition is not always respected by the user and the second can only be achieved on some boats whose halyard sheave is placed close to the point where the upper end of the shaft is fixed on which the tube of the roller rotates, by placing an additional guide pulley on the mast, so as to move the halyard away, which leads to a costly installation.

Furthermore, known rollers have two other disadvantages:

- the first is the possibility of wear or jamming of associated halyards such as the spinnaker halyard on the swivel stop placed at the upper part of the tube;
- the second is that, during hoisting of the sail, in the case where the hoist of the sail is too long following a cutting error or extension thereof, they lead to jamming of the swivel on the stop which, under the considerable force due to hoisting of the sail, destroys the stop or disassembles the tube of the roller at its junctions.

SUMMARY OF THE INVENTION

The invention provides a device which, in all cases, prevents the part of the swivel connected to the halyard from freely rotating, eliminates the possibilities of wear and jamming of the associated halyards on the roller and eliminates the disadvantages caused by using a sail with too long a hoist.

More precisely, this device is more particularly intended for limiting the rotational movement of the external part of the swivel of a sail roller equipping a sailing boat comprising at least one mast, a stay cable having an end portion adapted for connecting said stay to said mast and a halyard fixed to the swivel by fixing means and passing through guide means provided on the mast, said roller comprising at least one tube on which the sail may be rolled and which is mounted for rotation about said stay cable, said swivel comprising an inner part mounted for sliding on the tube and locked in rotation therewith, this inner part comprising means for securing the sail and an outer part fitted over the inner part and on which are mounted the means for securing said halyard.

According to the invention, this device comprises more particularly at least one piece interlocked axially and in rotation with said stay cable and situated in a zone between the upper end of said tube and said end portion, said piece comprising at least two abutment surfaces which extend radially and which cooperate with said means for securing the halyard on the swivel, when this latter is at the level of said end of the tube.

In an advantageous embodiment of the invention, the device comprises a piece whose periphery has the form of two semi cylinders with different radii joined together by their diametrical plane and whose axes merge. This piece, fixed to the shaft about which the roller rotates, generally formed by the stay cable, is situated between the upper end of the tube of the roller, i.e. the stop, and the end portion which connects the stay to the mast; the stay passes through the center of the half cylinders and the half cylinder with the smallest radius is orientated to the side where the halyard sheave is situated.

This piece defines then, at the level of the surfaces of the diametrical plane which project beyond the semi cylinder with the smallest radius, two angular stops for a connecting piece whose one end is fixed to the outer part of the swivel and the other to the halyard.

According to another characteristic of the invention the connecting piece is formed by a flat bar fixed flat to the outside of the swivel, so that in the absence of a force it is parallel to the stay and close to the smaller diameter half cylinder; the flat fixing is provided, on the one hand, so that the connection withstands the forces which will occur when it comes into contact with the stops and which will prevent the outer part of the swivel from following its rotation and, on the other hand, so that it has the required flexibility for orientating itself when the halyard is stretched towards the halyard sheave when this latter is moved away from the stay.

The purpose of the above assembly is principally to stop the outer part of the swivel from rotating in all cases: when the halyard sheath is close to the stay, the connection close the small radius cylinder will be rotated, then will come into abutment against one of the two stops, this operation being independent of the tension of the halyard. When the halyard sheave is moved away from the stay and when the halyard is stretched, the outer part of the swivel is still immobilized, this case corresponds to the roller well used.

When the halyard sheave is moved away from the stay and when the halyard is slackened, the outer part of the swivel, driven in rotation, tends to drive the connection and the end to which the halyard is fixed describes a circle of large radius, during this movement, the halyard is stretched and it exerts on the connection a force which returns it to the plane comprising the axis of rotation of the roller and the halyard sheave, the connection, which is flexible in the component of this force draws close to the small diameter cylinder and, if the movement continues, it comes into abutment against one of the above described stops, thus positively stopping the rotation of the outer part of the swivel.

According to another characteristic of the invention, the half cylinders are amply chamfered and rounded so that the fixing means used for bending the halyard to the connection, such as shackes, swivel hooks, etc . . . , do not when passing catch onto the piece comprising the stops, when the sail is hoisted or lowered, particularly when the halyard sheave is close to the stay. To further improve the passage of the fixing means, they are bent to a round closed ring inserted in a hole situated at the end of the connection; this ring holds the connection aside and, consequently, the fixing means by bearing, during the passage thereof, on the piece comprising the stops.

The flat bar which forms the connection may be fixed to the swivel by a screw and it comprises a succession of evenly spaced holes for adjusting the length of the connection depending on the assemblies met with, the adjustment being made by using the hole which is most suitable.

Moreover, the piece comprising the angular stops forms an axial stop for stopping the swivel in the top position before this latter reaches the end stop of the tube. For preventing the piece from sliding on the stay when a considerable force is exerted on the swivel in abutment, the assembly is provided by placing the piece in abutment against the end portion of the stay, at the end of crimping for example. So that the forces are correctly centered on the stop when the swivel comes into contact, this stop comprises an external cone which comes to bear on a conical seat forming part of the swivel. To simplify the construction of the parts forming the subject of the invention, the cone used for centering the swivel is continuous with the one formed for preventing the connections from catching on.

The piece with the stops may advantageously comprise a recess in its part situated towards the roller, so as to form a gap in which, during assembly, the swivel stop adjoining the tube will penetrate. This gap will prevent any wear or jamming, on the outer part of the tube, of associated halyards which can only bear against the periphery of the gap.

Furthermore, the piece comprising the stops and forming the gap is preferably formed in two half parts joined together by screws, which, when tightened, will provide immobilization on the stay, so as to facilitate assembly thereof.

BRIEF DESCRIPTION OF THE DRAWINGS

One embodiment of the invention will be described hereafter, by way of non limitative example, with reference to the accompanying drawings in which.

DESCRIPTION OF THE PREFERRED EMBODIMENT

Figure 1:
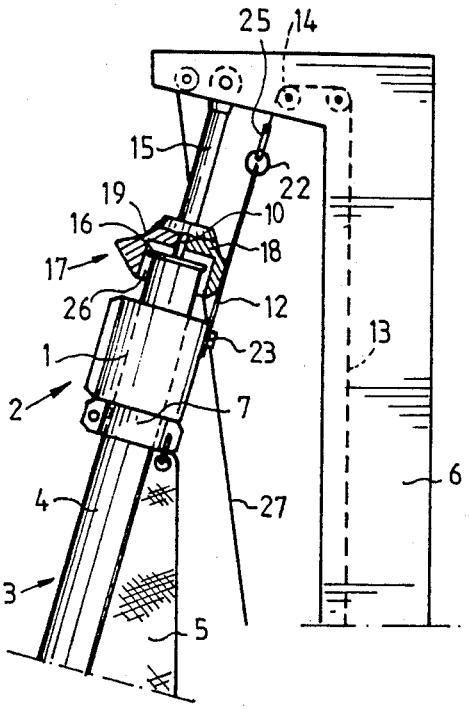
FIG. 1 is a partial side view of a roller mounted on a stay fixed to the head of a mast of a sailing boat

As mentioned above, the device of the invention serves for limiting the rotational movement of the outer part 1 of the swivel 2 of a sail roller 3 equipping the sailing boat.

This roller may comprise in a known manner, a tubular element or tube 4, on which sail 5 may be rolled up and which is mounted for rotation about a stay cable 10 of the rigging of the boat, which connects the mast 6 to a fixed part integral with the boat.

This tube 4 comprises at least one longitudinal groove extending over the whole of its length and opening out into its outer surface. This longitudinal groove serves for slidingly receiving the bolt rope of the sail. It is also provided in its lower part with an axial holding device securable to a fixed part of the boat as well as a drum for rotation thereof.

On the tube 4 is slidably mounted a swivel 2, to which is fixed the head of sail 5 and which may be driven longitudinally by a halyard 13 passed over a sheave 14 provided at the head of the mast 6.

The swivel 2 comprises an inner part 7 mounted for sliding on the tube and secured for rotation therewith by means of an inner projection which penetrates into the groove, said inner part 7 further having means for securing the head of the sail 5. On this inner part is mounted for rotation an external part 1 equipped with a connecting piece 12 to which is fixed the halyard 13.

Figure 5:
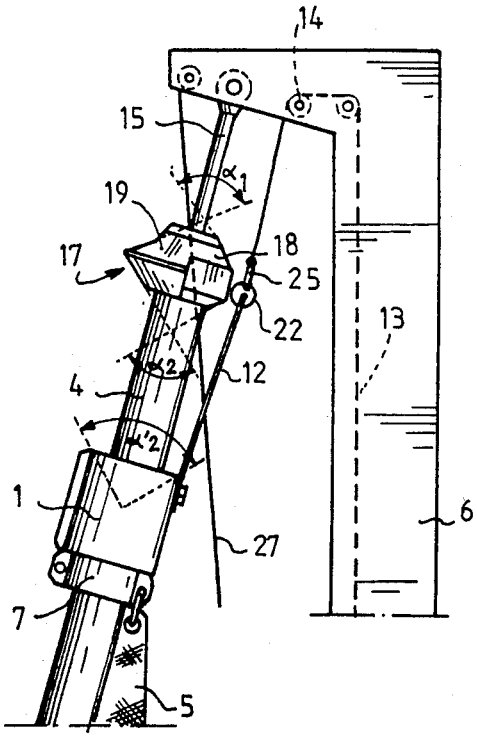
FIG. 5 is a view similar to that of FIG. 1 but in which the swivel occupies an intermediate position during hoisting of the sail.
Figure 3:
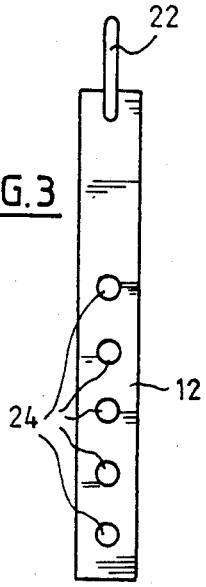
FIGS. 3 and 4 show, respectively in a front view and a side view, the piece providing the connection between the swivel and the halyard.
Figure 4:
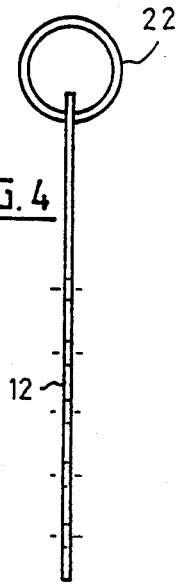

Thus, in the example shown in FIG. 1, roller 3, mounted on stay 10, is fixed to the head of mast 6 by a crimped end portion 15. The tube 4 of the roller on which swivel 2 slides comprises a stop 16 at its upper end. The device 17 for locking the outer part 1 of swivel 2 against rotation is formed from two half cylinders 18, 19 with different radii R1 and R2, R2 being greater than R1, and each comprising an axial semi-cylindrical groove 20, 20'. These two semi cylinders 18, 19 are assembled together through their diametrical plane, by means of two screws 21, 21', so that said axial grooves 20, 20' form a passage in which stay 10 is gripped. The assembly formed by the two half cylinders 18, 19 is therefore fixed against axial and rotational movement on stay 10. This assembly 18, 19 comes into abutment against the end portion 16 and the half cylinder 18 with radius R1 is positioned, during assembly, so that it is turned towards the sheave 14 of halyard 13. The outer part of swivel 2 which is to be secured against rotation comprises a connecting piece 12 having a ring 22, as shown in front and side views in FIGS. 3 and 4. This connecting piece 12 is fixed to the outer part 1 by means of a screw 23 which passes through one of the holes 24 chosen at the time of assembly so that ring 22 is situated above assembly 18, 19, when sail 5 is hoisted. Ring 22 is intended to hold the means 25 fixing the halyard 13 to ring 22 away from assembly 18, 19 when it passes close to said assembly (FIG. 5). In this example, the means 25 for fixing halyard 13 to ring 22 consist of a shackle.

Figure 2:
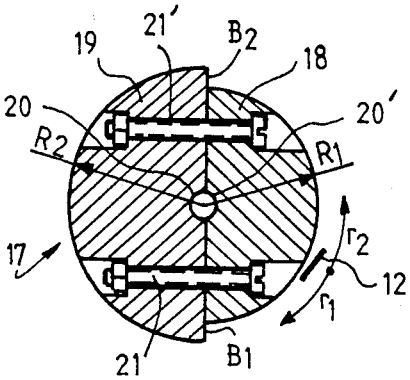
FIG. 2 is a cross section of the rotation locking device fitted to the roller shown in FIG. 1.

According to the invention, rotation (arrows r1, r2) of the outer part 1 of swivel 2 is prevented when the connecting piece 12 comes into abutment against one of the stops B1 or B2 shown in FIG. 2.

Furthermore, the assembly formed by the two half cylinders 18, 19 comprises conical parts $\alpha 1$, $\alpha 2$ for preventing the fixing means 25 from catching on and for facilitating the passage of the spacer ring 22. The cone $\alpha 2$ is further used for centering the swivel 2 when this latter comes into abutment against assembly 18, 19. This centering may be further improved by providing an inner chamfer $\alpha$ '2 on swivel 2.

The assembly 18, 19 further comprises a recess 26 situated on the roller side so as to receive stop 16, in order to protect the associated halyard 27.

What is claimed is:

1. A device for limiting the rotational movement of an outer part of a swivel of a sail roller equipping a sailing boat comprising at least a mast, a stay cable having an end portion adapted for connecting said stay to said mast and a halyard fixed to said swivel by fixing means and passing over guide means provided on the mast, said roller comprising at least one tube on which the sail may be rolled and which is mounted for rotation about said stay cable, said swivel comprising an inner part mounted for sliding on the tube and secured for rotation therewith, said inner part comprising means for fixing the sail, and said outer part mounted for rotation on said inner part and on which is mounted a connecting piece for fixing said halyard, said connecting piece extending from said outer part towards said end portion, said device further comprising at least one abutment piece fixed against axial and rotational movement on said stay cable and situated in a zone between the upper end of said tube and said end portion, said abutment piece comprising at least two abutment surfaces which extend radially and said connecting piece passing between said abutment surfaces, when the swivel is at the level of said upper end of the tube.

2. The device as claimed in claim 1, wherein said abutment piece comprises a surface portion serving as axial stop on which said swivel may come to bear.

3. The device as claimed in claim 2, wherein the axial stop is in the form of a cone and cooperates with a conical seat formed in the swivel.

4. The device as claimed in claim 1, wherein said abutment piece comprises a recess in which the upper end of the tube of the roller may be introduced.

5. The device as claimed in claim 1, wherein said abutment piece comprises two half cylinders with different radii assembled together through their diametrical plane, said half cylinders each comprising an axial groove defining, after assembly of the two half cylinders, an axial passage in which said stay is fixed.

6. The device as claimed in claim 5, wherein the ends of the two half cylinders are chamfered.

7. The device as claimed in claim 1, wherein said connecting piece comprises several fixing holes.

8. The device as claimed in claim 7, wherein said connecting piece comprises a ring.

9. The device as claimed in claim 8, wherein said connecting piece is formed by a flat bar.

* * * * *